US009269515B2

(12) United States Patent
Huang et al.

(10) Patent No.: US 9,269,515 B2
(45) Date of Patent: Feb. 23, 2016

(54) INSULATING CYLINDER AND A MAIN CIRCUIT STRUCTURE USING THE SAME

(71) Applicant: BEIJING HUADONG SENYUAN ELECTRIC CO., LTD., Beijing (CN)

(72) Inventors: Chuang Guo Huang, Beijing (CN); Shu Xuan Shi, Beijing (CN); Guo Yan Xu, Beijing (CN)

(73) Assignee: BEIJING HUADONG SENYUAN ELECTRIC CO., LTD., Beijing (CN)

( * ) Notice: Subject to any disclaimer, the term of this patent is extended or adjusted under 35 U.S.C. 154(b) by 48 days.

(21) Appl. No.: 13/954,257

(22) Filed: Jul. 30, 2013

(65) Prior Publication Data

US 2014/0175059 A1 Jun. 26, 2014

(30) Foreign Application Priority Data

Dec. 25, 2012 (CN) ..... 2012 2 0726897

(51) Int. Cl.
*H01H 33/662* (2006.01)
*H01H 33/666* (2006.01)
*H01H 31/00* (2006.01)

(52) U.S. Cl.
CPC ..... *H01H 33/66207* (2013.01); *H01H 33/6661* (2013.01); *H01H 31/003* (2013.01); *H01H 2033/6623* (2013.01); *H01H 2033/6665* (2013.01)

(58) Field of Classification Search
CPC ..... H01H 33/66; H01H 33/70; H01H 33/666; H01H 2033/6623; H01H 9/12; H01H 2009/0292; H01H 31/003; H01H 33/66207
USPC ..... 218/78, 79, 118, 120, 124, 136, 140, 218/154, 10, 42, 45, 55, 80, 134, 139, 155; 200/308; 335/42
See application file for complete search history.

(56) References Cited

U.S. PATENT DOCUMENTS

| | | | | |
|---|---|---|---|---|
| 7,579,571 | B2 * | 8/2009 | Siebens et al. | 218/120 |
| 7,829,814 | B2 * | 11/2010 | Marchand et al. | 218/140 |
| 7,943,881 | B2 * | 5/2011 | Gimeno et al. | 218/79 |
| 2011/0174779 | A1 * | 7/2011 | Lammers et al. | 218/118 |

FOREIGN PATENT DOCUMENTS

| | | | |
|---|---|---|---|
| CN | 101340066 | A | 1/2009 |
| CN | 102110956 | A | 6/2011 |
| CN | 102412519 | A | 4/2012 |
| CN | 202513073 | U | 10/2012 |
| CN | 202601500 | U | 12/2012 |

* cited by examiner

*Primary Examiner* — Renee S Luebke
*Assistant Examiner* — William Bolton
(74) *Attorney, Agent, or Firm* — Hamre, Schumann, Mueller & Larson P.C.

(57) ABSTRACT

An insulating cylinder and a main circuit structure using the insulating cylinder includes a main cavity, a secondary grounded insert connected with the main cavity, an arc-distinguishing chamber connected with the main cavity, and an outlet terminal insert connected with an end of the arc-distinguishing chamber. An observation window is provided at a side of the main cavity. A main circuit structure using the insulating cylinder, which further includes a main grounded rod and a main grounded contact positioned in the main cavity, an arc-distinguishing chamber insulating pole, an isolated insulating pole, an isolated conductive block, an isolated rod and an isolated contact, and a main bus-bar bushing connected with the isolated contact. A flexible connection is provided between the main grounded contact, the arc-distinguishing chamber and the isolated conductive block.

7 Claims, 6 Drawing Sheets

INSULATING CYLINDER AND A MAIN CIRCUIT STRUCTURE USING THE SAME

FIELD OF INVENTION

The present invention relates to the field of high voltage electric equipments. In particular, the present invention relates to an insulating cylinder and a main circuit structure using the insulating cylinder in the field of high voltage switchgear.

BACKGROUND

Existing ring main units generally use gas insulation, i.e., air insulation or $SF_6$ gas insulation. That is, the main circuit mounted in the insulating cylinder of ring main unit (RMU) adopts air or $SF_6$ gas as the insulation media. Due to its poor insulation and safety, the air insulation ring main unit has gradually become unadaptable to the requirements of the technology development. $SF_6$ gas ring main unit, compared to the air ring main unit, greatly improves insulation and safety due to its small volume, full insulation, and full sealing, and thus is widely used in city power grid. However, $SF_6$ is widely regarded as one of greenhouse gases, and its greenhouse effect is 2500 times of $CO_2$. Further, $SF_6$ can exist in the atmosphere up to 3400 years, and can produce toxic gas fluoride (e.g. $SF_4$, $S_2F_{10}$) under high voltage arc environment, so as to severely pollute the environment. Further, in view that $SF_6$ can produce toxic gas under high voltage arc environment, to prevent leakage, the $SF_6$ gas RMU is generally required to have high sealing and complex processing, which leads to the unit to have high cost and complex maintenance and test, such that the cost of manufacturing and maintenance is quite expensive. Furthermore, the charged body is exposed to $SF_6$ gas, which is easy to be eroded, leading to degradation of insulation level and easily to cause casualty/accidents.

Solid insulated vacuum ring main unit is considered to be the best choice to replace the gas insulated ring main unit due to its good insulation and stability, pollution-free, simple manufacturing and maintenance, and low cost. However, the switch in the existing solid RMU usually adopts two-position (i.e., working, isolation, ground) manner, and the main isolation is load-side isolation. During servicing, the main bus-bar must be disconnected, which reduces reliability of power supply. Further, it is difficult for the maintenance staff to confirm position of the switch, which may cause security risk.

Thus, there is a need for a novel insulating cylinder and a main circuit structure using such insulating cylinder, to facilitate maintenance of the switchgear and to have visible position indicator to ensure maintenance personnel's safety. Further, three-position manner (i.e., working, isolation and ground) is used to improve the insulating property of the product, to further improve safety of the product.

SUMMARY

In view of the above problems in the existing technology, the present invention provides a novel insulating cylinder and a main circuit structure using the insulating cylinder. The insulating cylinder seals a vacuum interrupter of switchgear (breaker or load switch) and a main conductive portion of an isolation and ground switch in a cavity encapsulated with epoxy resin, which not only saves space and material but also improves safety of the product. Further, vacuum is used as internal insulation and arc-extinguishing medium, and solid insulating material is used as external insulating medium, which do not emit any toxic substances and meet the environmental requirements. Further, the insulating cylinder and the main circuit structure using the insulating cylinder are designed to meet the national standards and relevant standards, e.g., to meet the position indicator as required at 5.104.3.1 of Standard GB 1985-2004 by arranging a view window, to facilitate observation of position of grounding rod and insulation rod, to identify position of working, isolation and grounding.

In order to achieve the above objectives, the present invention provides the following technical solutions:

An insulating cylinder has an insulating cylinder body, wherein the insulating cylinder further comprises a main cavity, a secondary grounded insert connected with the main cavity, an interrupter (arc-extinguishing chamber) connected with the main cavity, and an outlet terminal insert connected with an end of the arc-extinguishing chamber; and, a side of the main cavity is provided with a view window.

In one embodiment, an outgoing line of the secondary grounded insert can be extended from one side of the insulating cylinder.

In one embodiment, an outlet terminal of the outlet terminal insert connected with the end of the arc-extinguishing chamber is on the same side as the outgoing line of the secondary grounded insert.

In one embodiment, the insulating cylinder can be integrally molded from epoxy resin.

In one embodiment, the secondary grounded insert can be molded in the insulating cylinder.

In one embodiment, the arc-extinguishing chamber can be molded in the insulating cylinder.

In one embodiment, the main circuit structure adopts the above insulating cylinder, the main circuit structure further comprises a main grounded rod and a main grounded contact positioned in the main cavity, an insulating pole of the arc-extinguishing chamber, an isolated insulating pole, an isolated conductive block, an isolated pole and an isolated contact, and a main bus-bar bushing connected with the isolated contact; wherein a flexible connection is provided between the main grounded contact, the vacuum interrupter (vacuum arc-extinguishing chamber) and the isolated conductive block.

In one embodiment, the main circuit structure further includes a grounded position indication mark and a disconnection position indication mark positioned on the main grounded rod, and an isolated position indication mark positioned on the isolated rod.

In one embodiment, the main circuit structure further comprises a secondary grounded rod and a secondary grounded contact positioned in the main cavity; wherein the diameter of the secondary grounded rod is smaller than the diameter of the main grounded rod.

In one embodiment, the main circuit structure further comprises a grounded position indication mark and a disconnection position indication mark positioned on the main grounded rod and the secondary grounded rod, and an isolated position indication mark positioned on the isolated rod.

It should be understood that individual features of the above embodiments can have any combination, to achieve the technical results of the present invention.

Comparing with the prior art, the above insulating cylinder and the main circuit structure using such insulating cylinder have the following advantages and effects:

1) The insulating cylinder and the main circuit structure using the insulating cylinder as disclosed in the present invention can save space and material and improve safety of the product; without discharging any toxic substances, which fully comply with the environmental requirements.

2) The insulating cylinder and the main circuit structure using the insulating cylinder as disclosed in the present invention are designed to meet the requirements of national standards and relevant standards, wherein the switchgear can be arranged at working position, isolated position and grounded position. Further, a visible view window is arranged to observe and confirm the switch position, especially during maintenance to facilitate the maintenance personnel to view the position indication of the grounded rod and isolated rod, to ensure personnel's safety.

3) The insulating cylinder and the main circuit structure using the insulating cylinder as disclosed in the present invention arrange the main bus-bar at the lower end of the insulating cylinder isolated cavity, for multi-line wiring and fixing and for facilitating insulation between wirings.

BRIEF DESCRIPTION OF THE DRAWINGS

In connection with the drawings, embodiments of the present invention can be better understood. In the drawings, identical reference numerals represent identical/similar parts. Wherein.

DETAILED DESCRIPTION

Detailed description will be made to the insulating cylinder and the main circuit structure using the insulating cylinder in connection with the drawings and embodiments.

Figure 1:
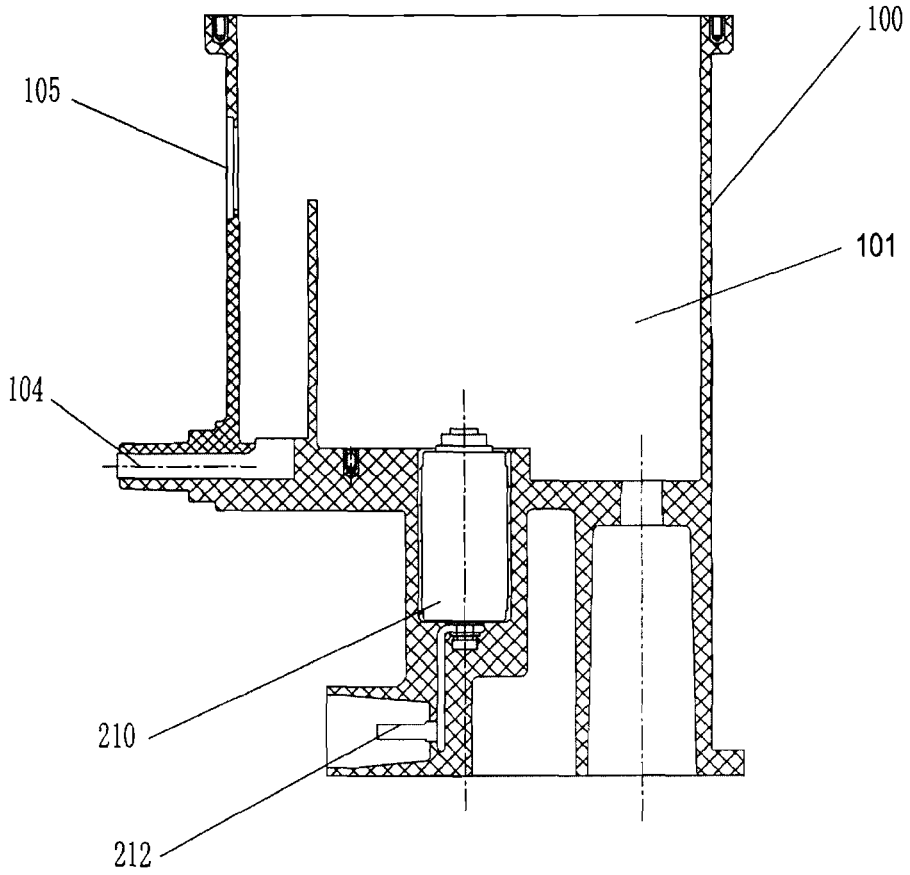
FIG. 1 is a schematic view of an insulating cylinder according to one embodiment of the present invention.

FIG. 1 shows a schematic view of an insulating cylinder 100 according to one embodiment of the present invention. The insulating cylinder body can be integrally molded using epoxy resin or other insulation materials, by automatic pressure gel technology. As shown in FIG. 1, the insulating cylinder 100 is provided with a main cavity 101, a secondary grounded insert 104 connected with the main cavity 101, a vacuum interrupter (vacuum arc-extinguishing chamber) 210 connected with the main cavity 101, and an outlet terminal insert 212 connected with one end of the vacuum interrupter 210. Further, a view window (observation window) 105 is arranged at a side of the main cavity 101. It should be understood that FIG. 1 only exemplarily shows a possible embodiment. If desired, the size, shape, specific position and direction of the observation window 105, secondary grounded insert 104, arc-distinguishing cavity 110 and outlet terminal insert 212 can be changed based on actual situation. Also, arrangement of individual cavities can be accordingly adjusted based on the design.

Preferably, individual cavities can encapsulate respective electrical components, to realize good insulation between electrical components, reduce switch volume and simplify manufacturing process. Further, interior of the insulating cylinder can be observed through the observation window 105 on one side of the insulating cylinder, so as to confirm and inspect working status of various components. This will be further explained below.

Preferably, the grounded insert 104 can be directly cast or by other ways fixed within the insulating cylinder 100. In the present embodiment, the material of the grounded insert 104 can choose copper or aluminum (Cu or Al). Of course, other suitable materials are also possible.

Preferably, the vacuum interrupter 210 and the outlet terminal insert 212 can be directly diecast within the insulating cylinder 100.

Figure 2:
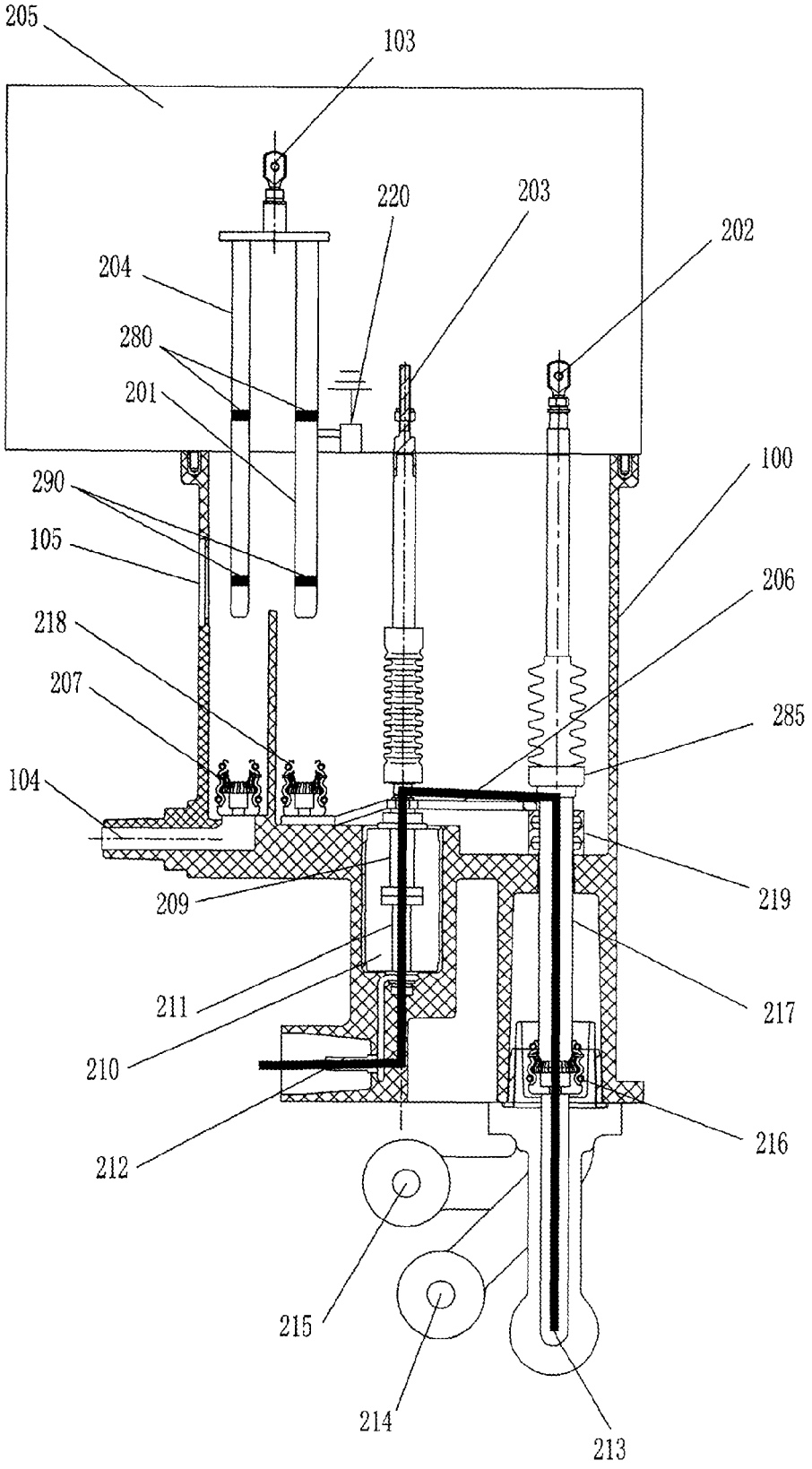
FIG. 2 is a schematic view of a main circuit structure using the insulating cylinder as shown in FIG. 1 according to one embodiment of the present invention, wherein the main circuit is in the working (closing) position.
Figure 3:
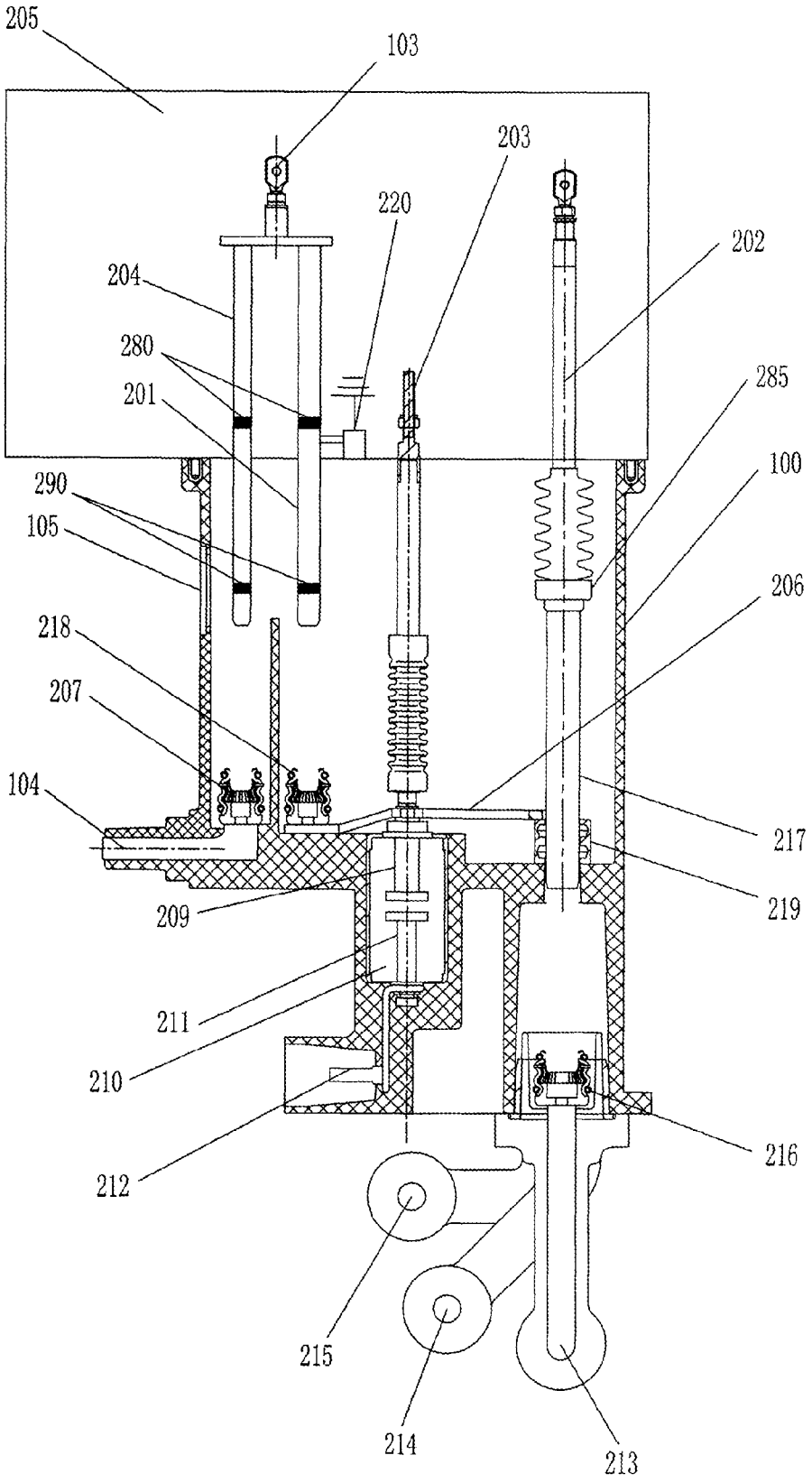
FIG. 3 is a schematic view of a main circuit structure using the insulating cylinder as shown in FIG. 1 according to one embodiment of the present invention, wherein the main circuit is in the middle (isolated) position.
Figure 4:
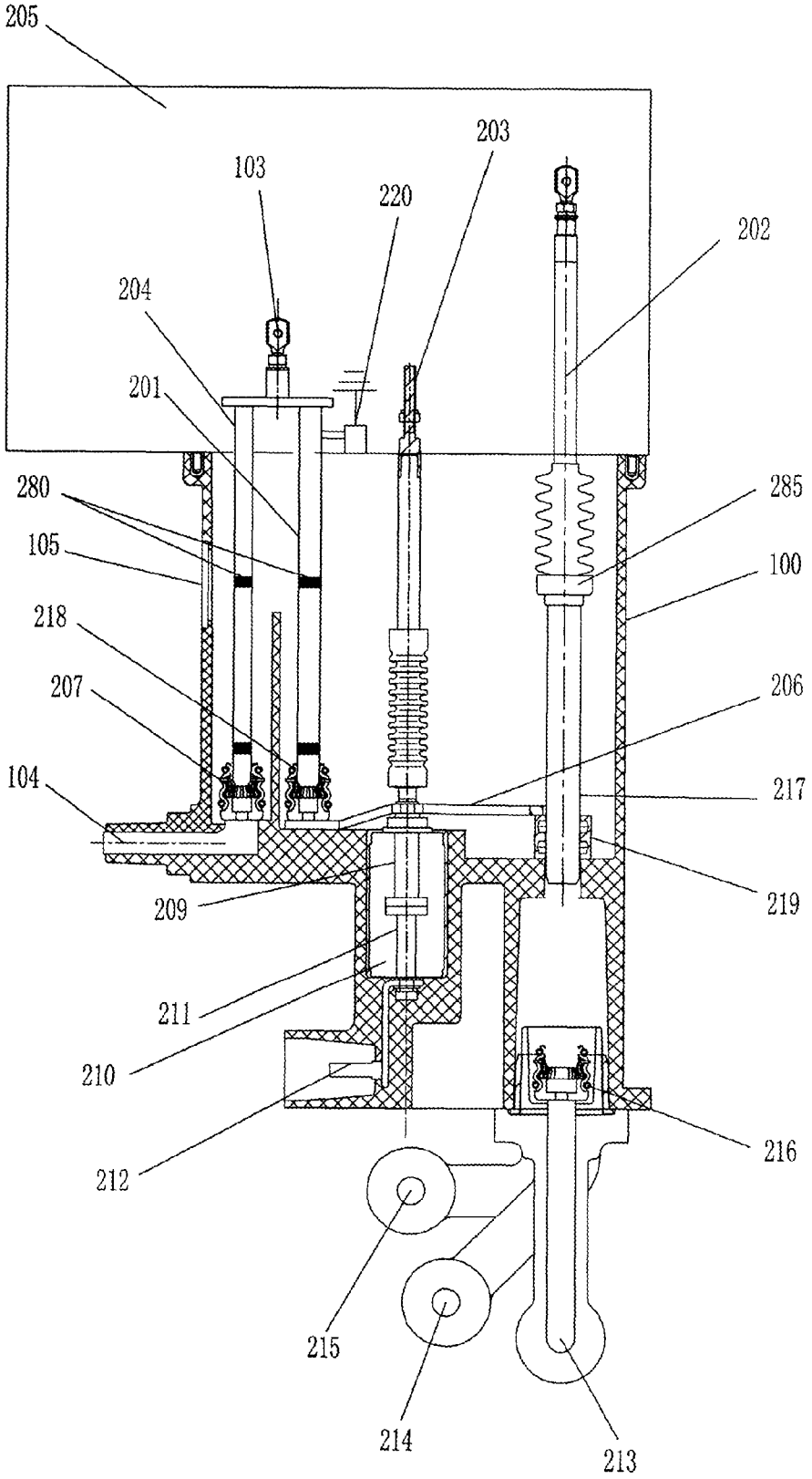
FIG. 4 is a schematic view of a main circuit structure using the insulating cylinder as shown in FIG. 1 according to one embodiment of the present invention, wherein the main circuit is in the service (grounded) position.

FIGS. 2-4 schematically show a main circuit structure using the insulating cylinder as shown in FIG. 1 in closing, isolated and grounded position, respectively, according to one embodiment of the present invention. As shown in FIGS. 2-4, the main circuit structure comprises: an insulating cylinder 100; a main grounded rod 201 and a main grounded contact 218 positioned in the main cavity 101, a secondary grounded rod 204 and a secondary grounded contact 207, an arc-extinguishing chamber insulating pole 203, an isolated insulating pole 202, an isolated conductive block 219, an isolated rod 217 and an isolated contact 216. The main grounded rod 201 is close to the observation window 105 (i.e., the main grounded rod is positioned in front), and its end in the operating mechanism 205 is connected with a secondary grounded rod 204 through the grounded connection rod 103, so that the main grounded rod 210 and secondary grounded rod 204 can synchronously act. Further, the main grounded rod 210 is connected to the main grounded block 220. The secondary grounded contact 207 is connected with the grounded insert 104. The main grounded contact 218 is connected with one end of the arc-extinguishing chamber 210 and the isolated conductive block 219 via the flexible connection 206.

It can be seen from the drawings that the diameter of the secondary grounded rod 204 is smaller than the diameter of the main grounded rod 201. In this way, one can observe the position indication mark of the secondary grounded rod 204 and the position indication of the main grounded rod 201 from the observation window 105. Also, the position indication 285 of the isolated rod at isolated state can be observed. The isolated contact 216 is fixed on the main bus-bar bushing (e.g., main busbar bushing A 215, main busbar bushing B 214 and main busbar bushing C 213 as shown). The main busbar bushing 213, 214, 215 are secured at the lower end of the main cavity 101 of the main circuit, respectively, which can be arranged as shown in the drawings, or arranged in other forms such as triangle shaped.

In the embodiment as shown in FIGS. 2-4, the operating mechanism 205 can be spring operating mechanism, or other suitable type of operating mechanism. From the drawings, it can be seen that the main grounded rod 201 and secondary grounded rod 204 are connected with the operating mechanism 205, respectively. The end of the main grounded rod 201 and the end of the secondary grounded rod 204 in the operating mechanism 205 are connected via the grounded connection rod 103. Further, the isolated rod 217 is connected with the operating mechanism 205 via the isolated insulating pole 202, and the moving rod 209 of the vacuum interrupter 210 is connected with the operating mechanism 205 via the insulating pole 202 of the arc-extinguishing chamber. The operating mechanism 205 drives the main grounded rod 201 and the secondary grounded rod 204 to slide up and down synchronously, so that an end of the main grounded rod 201 and secondary grounded rod 204 (e.g., lower end) can be inserted into the main grounded contact 218 and secondary grounded contact 207, respectively, to achieve grounding.

The vacuum interrupter 210 is held in the arc-extinguishing chamber 210 of the insulating cylinder 100, in which one end is a stationary end and the other end is a moving end. In this embodiment, the stationary end of the vacuum interrupter 210 is downward, so that the stationary rod 211 is connected with an end of the outlet terminal insert 212 by screw or other fasteners; and, the other end of the outlet terminal insert 212 is led out. The moving end of the vacuum interrupter 210 is upward, such that the moving rod 209 is connected with the insulating pole 203 of the interrupter. Silica gel can be filled between the vacuum interrupter 210 and the insulating cylinder 100, or the vacuum interrupter 210 can be encapsulated in the insulating cylinder 100 when casting the insulating cylinder 100 (as shown in the present embodiment). The flexible connection 206 is arranged on the moving end face of the vacuum interrupter 210. As discussed above, the middle part of the flexible connection 206 is pressed on the end face of the moving end by the insulating pole 203, and the two ends of the flexible connection 206 are respectively secured to the main grounded contact 218 and isolated conductive block 219 by screws (or by welding). The main grounded contact 218 and the isolated conductive block 219 are secured onto the insulating cylinder 100 by screws. The end of the insulating pole 203 opposite to the end pressed on the moving end face is connected to the operating mechanism 205. The isolated conductive block 219 has a contact finger slidably connected with the isolated rod 217. The upper end of the isolated rod 217 is connected with an end of the isolated insulating pole 202, with the isolated rod indication mark 285 at the joint. The other end of the isolated insulating pole 202 is connected with the operating mechanism 205.

In use, the main circuit structure drives individual rods/poles with the operating mechanism 205 to allow the switchgear to be in working position, isolating position and grounding position, respectively.

FIG. 2 schematically shows the switchgear in the working (close) position. In use, the main grounded rod 201 and the secondary grounded rod 204 are driven by the operating mechanism 205 to move upwards synchronously, so that the main grounded rod 201 and secondary grounded rod 204 are respectively disconnected from the main grounded contact 219 and secondary grounded contact 207 for a certain distance (the distance meet the national standards, e.g., more than 125 mm). Next, the operating mechanism 205 drives the isolated rod 217 to move downwardly via the isolated insulating pole 202, so that the isolated rod 217 is inserted into the isolated contact 216 so as to communicate with the main bus-bar 221. Next, the operating mechanism 205 drives the moving rod 209 in the vacuum interrupter 210 to move downwardly via the insulating pole 203, so that the moving rod 209 drives the move contact to contact with the stationary contact on the stationary rod 211. In this way. the switchgear completes closing, and the main busbar is electrically connected with the outlet terminal insert 212(see the black bold line as shown in FIG. 2). The switchgear is in operation. Now, the disconnection indication marks on the main grounded rod 201 and secondary grounded rod 204 and the isolated insulating pole 202 can be observed from the observation window 105.

FIG. 3 schematically shows a switchgear in the isolated (middle) position. In FIG. 3, the operating mechanism 205 drives the moving rod 209 of the vacuum interrupter 210 to move upwardly via the insulating pole 203, so that the moving contact on the moving rod 209 is disconnected from the stationary contact on the stationary rod 211, to allow the switchgear to open. Next, the operating mechanism 205 drives the isolated rod 217 to move upwardly via the isolated insulating pole 202, so that the isolated rod 217 is disconnected from the isolated contact 216 for a certain distance (this distance meets the national standards, e.g., more than 150 mm). Now, the switchgear is in the isolated position. When the switchgear at the isolated position needs to be closed (i.e., working state), the operation in connection with FIG. 2 can be repeated. When the switchgear in the isolated position needs to be grounded (for service), the operation as discussed below in connection with FIG. 4 will be performed to make the switchgear to be in the grounded position. Here, the visible indication marks of the main grounded rod 201 and secondary grounded rod 204 observed from the observation window 105 are still disconnection indication marks 290. However, in contrast to FIG. 2, the isolated position indication mark 285 of the isolated rod 217 can be observed from the observation window 105.

FIG. 4 schematically shows a switchgear at the service (grounded) position. In FIG. 4, the operating mechanism 205 drives the main grounded rod 201 and the secondary grounded rod 204 to move downward synchronously, so that the main grounded rod 201 and the secondary grounded rod 204 are respectively inserted into the main grounded contact 218 and secondary grounded contact 207, with connection of the grounded contact 207 and the grounded insert 104 to allow the switchgear to be in the grounded position for servicing. Here, the visible indication marks of the main grounded rod 201 and the second grounded rod 204 observed from the observation window 105 are grounded position indication marks 280, while the isolated position indication mark 285 as shown in FIG. 3 remains unchanged. Next, the insulating pole 203 of the operation breaker moves downwards, to have the moving contact and stationary contact to be closed, so that the outlet terminal can be reliably grounded.

In this way, the servicing staff can know the position of the switchgear only by looking into the view window 105 to observe the position indication marks of the grounded rod and isolated rod. This ensures the staff's safety.

Figure 5:
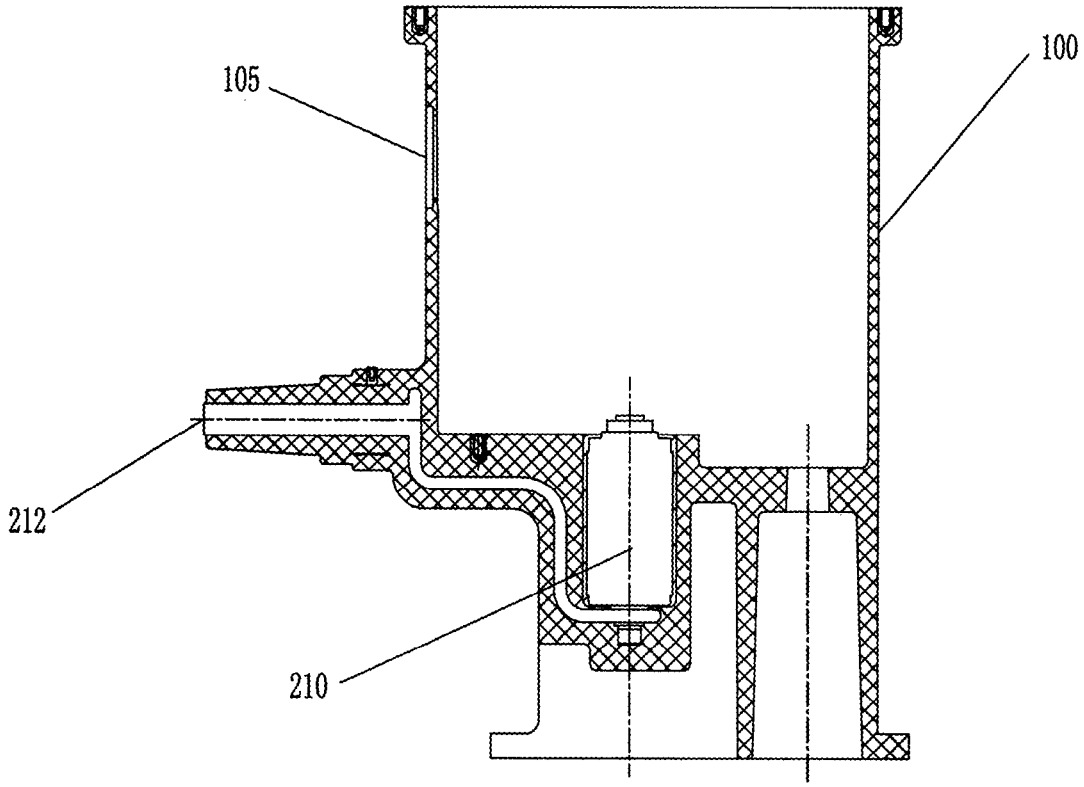
FIG. 5 is a schematic view of an insulating cylinder according to another embodiment of the present invention.

FIG. 5 shows an insulating cylinder according to another embodiment of the present invention. In the embodiment as shown in FIG. 5, the structure of the insulating cylinder is generally identical to that as shown in FIG. 1, except that no secondary grounded insert is provided here. Its application in the main circuit structure is generally identical to that as shown in FIGS. 2-4.

Figure 6:
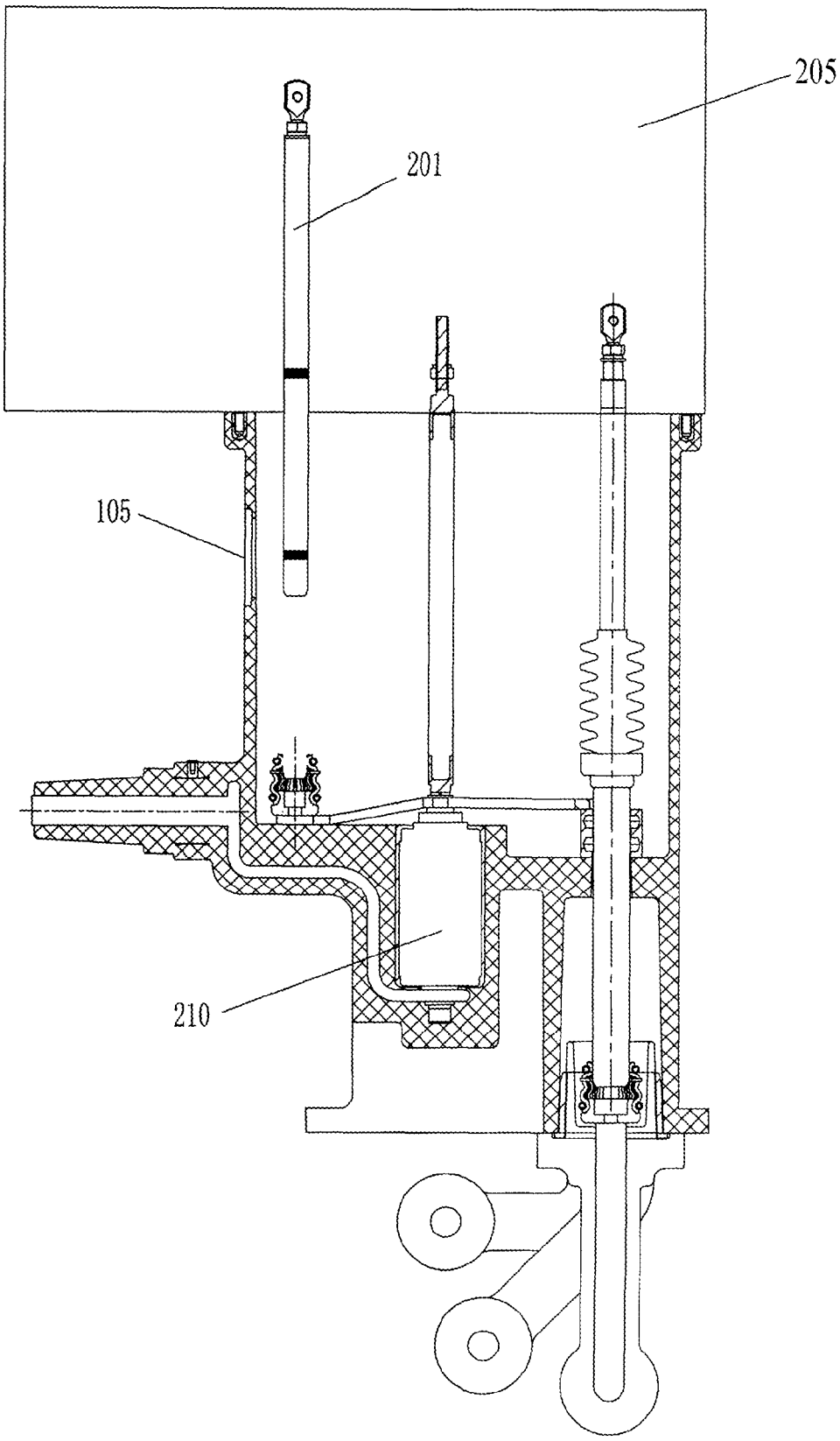
FIG. 6 is a schematic view of a main circuit structure using the insulating cylinder as shown in FIG. 5 according to another embodiment of the present invention.

FIG. 6 shows a main circuit structure using the insulating cylinder as shown in FIG. 5 according to another embodiment of the present invention. In FIG. 6, the main circuit structure is generally identical to that shown in FIGS. 2-4, except that no secondary grounded rod is provided (i.e., only providing main grounded rod).

Preferably, the insulating cylinder main circuit having secondary grounded rod is mainly used for combined electrical cabinet, i.e., ring main unit having fuse. Since the outlet side (cable side) is grounded instead of hanging ground wire at the cable side as used in the existing ring main unit, potential injury to the servicing staff caused by reverse power transmission when replacing the fuse can be avoided, which ensures safety of the service staff.

Preferably, the insulating cylinder main circuit without secondary grounded rod is mainly used for load switch or breaker.

In the main circuit structure using the insulating cylinder 100, use of the integral insulating cylinder 100 reduces the switch volume, improves insulation property and enhances equipment stability. Further, position indication of the grounded rod(s) and position of the insulating rod can be directly observed from the observation window, which avoids safety issues possibly caused by failure of connection between the operating mechanism and pole or the operating mechanism unable to effectively drive the internal switch components in place, and ensures safety of the servicing staff.

The present invention is not limited to the above particular embodiments. Various modifications and changes can be made to the insulating cylinder and the main circuit structure using the insulating cylinder by people skilled in the art in accordance with the teaching of the present invention. All such modifications and changes shall be considered as within the scope of the present invention. Even though the drawings show the best modes of the present invention, in practice the insulating cylinder and the main circuit structure using the insulating cylinder of the present invention may not be necessary to include all the shown features, in order to obtain all or some advantages of the present invention. Thus, the protection scope of present invention shall be determined by the appended claims instead of the best modes as discussed above.

The invention claimed is:

1. An insulating cylinder, comprising:

an insulating cylinder body;

a main cavity;

a secondary grounded insert connected with the main cavity;

an arc-extinguishing chamber connected with the main cavity; and an outlet terminal insert connected with an end of the arc-extinguishing chamber, wherein an outgoing line of the secondary grounded insert is extended from a side of the insulating cylinder; and an observation window is provided at a same side of the main cavity as the outgoing line of the secondary grounded insert;

wherein the arc-extinguishing chamber is provided between the main cavity and the outlet terminal insert in a height direction, and wherein an outlet terminal of the outlet terminal insert connected with a lower end of the arc-extinguishing chamber is on a same side as the outgoing line of the secondary grounded insert.

2. A main circuit structure using an insulating cylinder, wherein the main circuit structure uses an insulating cylinder, the insulating cylinder comprising:

an insulating cylinder body;

a main cavity;

a secondary grounded insert connected with the main cavity;

an arc-extinguishing chamber connected with the main cavity; and an outlet terminal insert connected with an end of the arc-extinguishing chamber, wherein an outgoing line of the secondary grounded insert is extended from a side of the insulating cylinder; and an observation window is provided at a same side of the main cavity as the outgoing line of the secondary grounded insert;

wherein the arc-extinguishing chamber is provided between the main cavity and the outlet terminal insert in a height direction, wherein the main circuit structure further comprises a main grounded rod and a main grounded contact positioned in the main cavity, an arc-extinguishing chamber insulating pole, an isolated insulating pole, an isolated conductive block, an isolated rod and an isolated contact, and a main bus-bar bushing connected with the isolated contact, and wherein a flexible connection is provided between the main grounded contact, the arc-extinguishing chamber and the isolated conductive block.

3. The main circuit structure according to claim 2, wherein:

the main circuit structure further comprises a grounded position indication mark and a disconnection position indication mark on the main grounded rod, and an isolated position indication mark on the isolated rod.

4. The main circuit structure according to claim 2, wherein:

the main circuit structure further comprises a secondary grounded rod and a secondary grounded contact in the main cavity, wherein a diameter of the secondary grounded rod is smaller than that of the main grounded rod.

5. The main circuit structure according to claim 2, wherein the observation window is provided adjacent to the main grounded rod so that a position of the main ground rod is visible from an outside of the insulating cylinder.

6. The main circuit structure according to claim 4, wherein:

the main circuit structure further comprises a grounded position indication mark and a disconnection position indication mark on the main grounded rod and the secondary grounded rod, and an isolated position indication mark on the isolated rod.

7. The main circuit structure according to claim 4, wherein the observation window is provided adjacent to the main grounded rod and the secondary grounded rod so that positions of the main ground rod and the secondary grounded rod are visible from an outside of the insulating cylinder.

* * * * *